US005108014A

United States Patent [19]

Nordmeyer et al.

[11] Patent Number: 5,108,014

[45] Date of Patent: Apr. 28, 1992

[54] FILLING VALVE

[75] Inventors: Manfred Nordmeyer; Helmut Grüne, both of Schwarmstedt, Fed. Rep. of Germany

[73] Assignee: Leider Maschinenbau GmbH & Co. KG, Schwarmstedt, Fed. Rep. of Germany

[21] Appl. No.: 513,002

[22] Filed: Apr. 10, 1990

Related U.S. Application Data

[63] Continuation of Ser. No. 157,477, Feb. 17, 1988, abandoned.

[30] Foreign Application Priority Data

Feb. 17, 1987 [DE] Fed. Rep. of Germany ..... 3704901

[51] Int. Cl.[5] ..... B67D 5/40

[52] U.S. Cl. ..... 222/380; 222/148; 222/452

[58] Field of Search ..... 222/168.5, 309, 148, 222/380, 383, 386, 452, 453; 141/141-143, 146, 147

[56] References Cited

U.S. PATENT DOCUMENTS

| | | | |
|---|---|---|---|
| 2,074,041 | 3/1937 | Baldwin | 222/380 X |
| 3,037,674 | 6/1962 | Brady et al. | 222/380 X |
| 3,127,071 | 3/1964 | Bingham | 222/452 X |
| 3,168,225 | 2/1965 | Miller et al. | 222/380 |
| 3,227,325 | 1/1966 | Bates | 222/309 |
| 3,833,155 | 9/1974 | Farfaglia | 141/147 X |
| 3,889,726 | 6/1975 | Stigler | 141/142 |
| 4,178,929 | 12/1979 | Voegele | 222/380 X |
| 4,293,010 | 10/1981 | Winiasz | 222/309 X |
| 4,437,498 | 3/1984 | Pankratz et al. | 222/380 X |

*Primary Examiner*—Kevin P. Shaver
*Attorney, Agent, or Firm*—Peter K. Kontler

[57] ABSTRACT

A filling valve wherein a piston is mounted for angular movement about a vertical axis immediately above a thin bottom wall of a housing which defines a metering chamber for a flowable material to be introduced into a succession of vessels. The material which is to be dispensed flows from a metering chamber in the housing through one or more channels in the piston and into and from dispensing openings in the bottom wall. The bottom surface of the piston has sharp sealing edges which slide along the upper side of the bottom wall and shear off the flow of material at the outlets of the channels when the piston is turned to a position in which the outlets of the channels are sealed from the dispensing openings in the bottom wall. This prevents dripping of flowable material in such position of the piston.

10 Claims, 6 Drawing Sheets

Fig. 6a
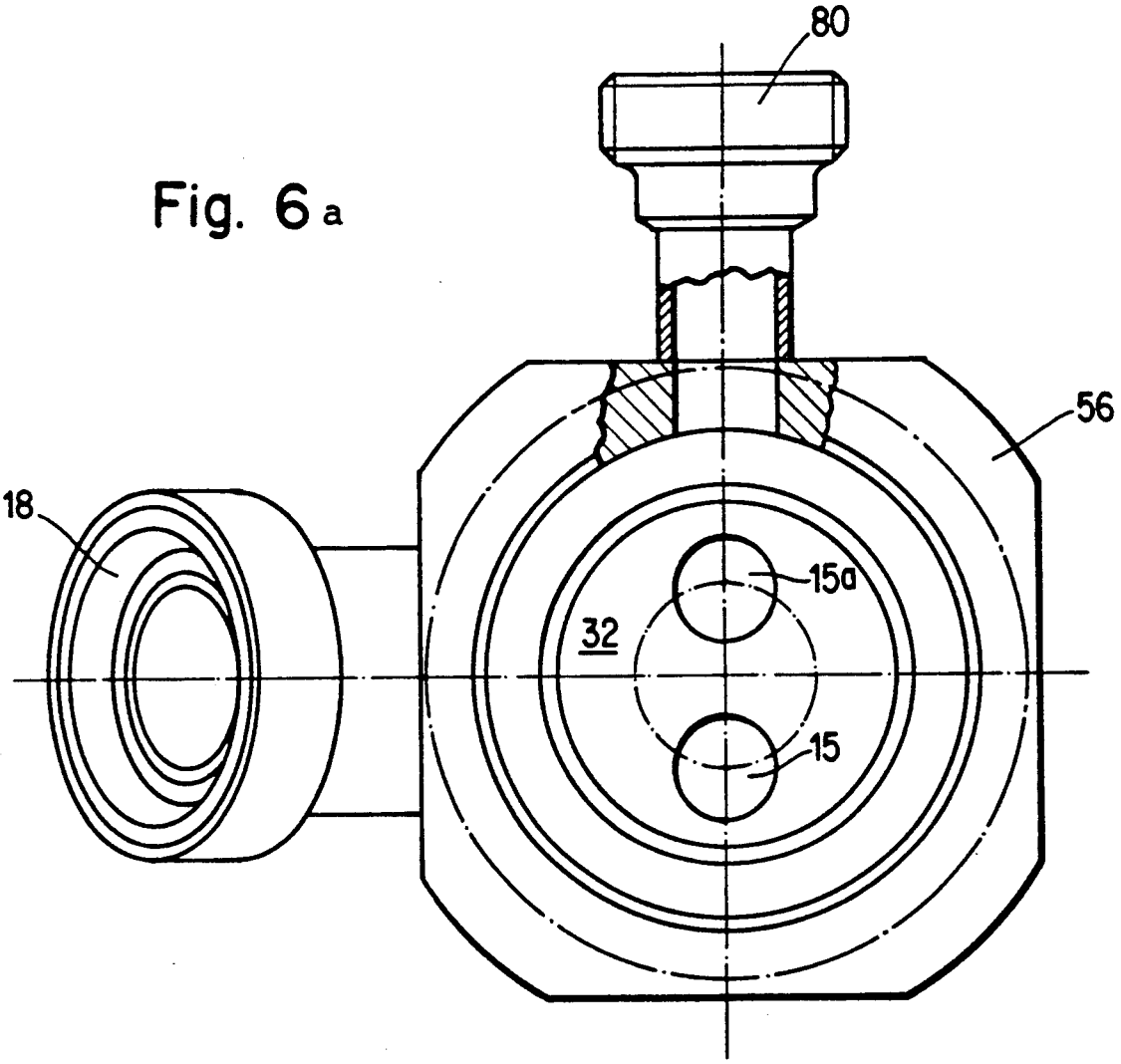
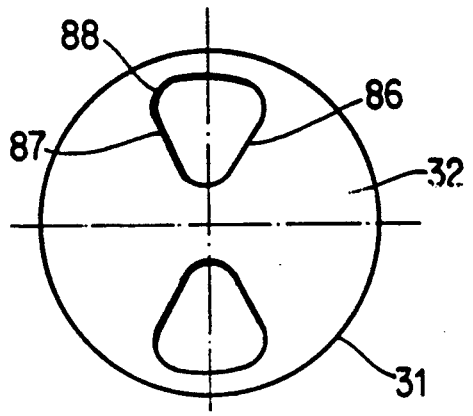
Fig. 6b

FILLING VALVE

This application is a continuation of application Ser. No. 157,477, filed Feb. 17, 1988, now abandoned.

BACKGROUND OF THE INVENTION

The invention relates to a filling valve for dispensing flowable masses with a sealing piston which is disposed in a housing and comprises at least one sealing edge which is movably disposed in the region of and can control at least one dispensing opening which is provided in the housing.

For example, such filling valves are employed in order to fill suitable vessels with flowable filling products. They can find utilization in order to dispense milk in metered quantities in packaging units, for example, cups. Furthermore, one can also take into consideration dispensable products which constitute a mixture of several partial products, for example, stirrable yogurt or yogurt with fruits.

Filling valves which were heretofore employed for such purposes comprises a sealing piston which can be moved through a housing substantially in a vertical direction. In order to open the filling valve, the sealing piston is moved out of the housing and a filling opening in a direction toward the vessel to be filled. After the vessel has been filled, the sealing piston is again pulled back into the housing. During such movement of the sealing piston, the stream of the material to be dispensed and flowing through the dispensing opening is supposed to be sheared off by the correspondingly configurated edges of the sealing piston within the dispensing opening.

Problems arise in connection with such filling valves especially when such filling valves are to dispense mixtures of different partial products. In such instances, one can assume that, during closing of the dispensing opening, solid constituents of the products to be dispensed become wedge between the sealing piston and the dispensing opening in the course of the closing step. In order to prevent such wedging, the edges surrounding the dispensing opening on the one hand and the edges of the sealing piston on the other hand are as sharp as possible in order to establish the conditions for shearing off the solid constituents by the moving sealing piston in the dispensing opening. However, such shearing effect does not develop in many instances because, in view of the yieldable mounting of the sealing piston and its relatively long unguided portion, one cannot avoid that the piston is deflected by the solid constituent to be sheared off within the dispensing opening. Portions of solid constituents which are to be sheared off are wedged during movement of the sealing piston between the piston and the dispensing opening and cause the development of a leak spot through which the liquid constituents of the product to be dispensed can trickle even at the times when a vessel to be filled is located beneath the dispensing opening. The product to be dispensed drips from the only partially sealed dispensing opening onto the guide elements on which the vessels to be filled are transported to positions beneath the dispensing opening or onto the vessels themselves to thus prevent a sealing of the vessels.

OBJECT OF THE INVENTION

Accordingly, it is an object of the present invention to improve a filling valve of the initially described type in such a way that it renders it possible to accurately terminate the filling operation.

SUMMARY OF THE INVENTION

In accordance with the invention, this object is accomplished in that the sealing edge is mounted for movement transversely of the direction of flow of mass through the dispensing opening.

Due to such movement of the sealing edge transversely of the direction of flow of mass that issues from the dispensing opening, one achieves that the sealing edge can be reliably guided in the course of the sealing operation. A deflection of the sealing edge within the dispensing opening is not possible even when a solid constituent of the mass to be filled is clamped between the sealing edge and the dispensing opening. Such solid constituent is sheared off with a high degree of reliability by the accurately guided sealing edge. Accurate guidance of the sealing edge is rendered possible, among others, in that the dimensions of the sealing piston transversely of the direction of flow of mass through the dispensing opening are sufficient to impart to the sealing piston a pronounced stiffness and to ensure its reliable guidance in the housing. In contrast thereto, a piston which is to be caused to leave the housing is not guided outside of the housing. In accordance with a preferred embodiment of the invention, the housing and the sealing piston which is disposed therein have axes which extend substantially in a vertical direction and the sealing piston is mounted for angular movement about its axis. Such filling valves the axes of which extend in a vertical direction were heretofore preferred for utilization in connection with the dispensing of flowable masses because they render it possible that, in their region, the masses to be dispensed can flow substantial'y without deflection. On the other hand, when the rotary slide valves are horizontal so that their axes are disposed in a substantially horizontal direction, one must accept repeated deflection of the material to be dispensed. Such deflections are not damaging in connection with many products but are not desirable with many others. For example, milk products must be packed with great care without repeated change of direction as a result of application of pressure during dispensing.

Further details of the invention will be furnished in the following detailed description and the accompanying drawing in which preferred embodiments of the invention are illustrated by way of example.

BRIEF DESCRIPTION OF THE DRAWING

In the drawings, there are shown in:

FIG. 6*a*: a top plan view of a housing from which the sealing piston was withdrawn, FIG. 6*b*: an end elevation view of the sealing piston.

DESCRIPTION OF PREFERRED EMBODIMENTS

Figure 1:
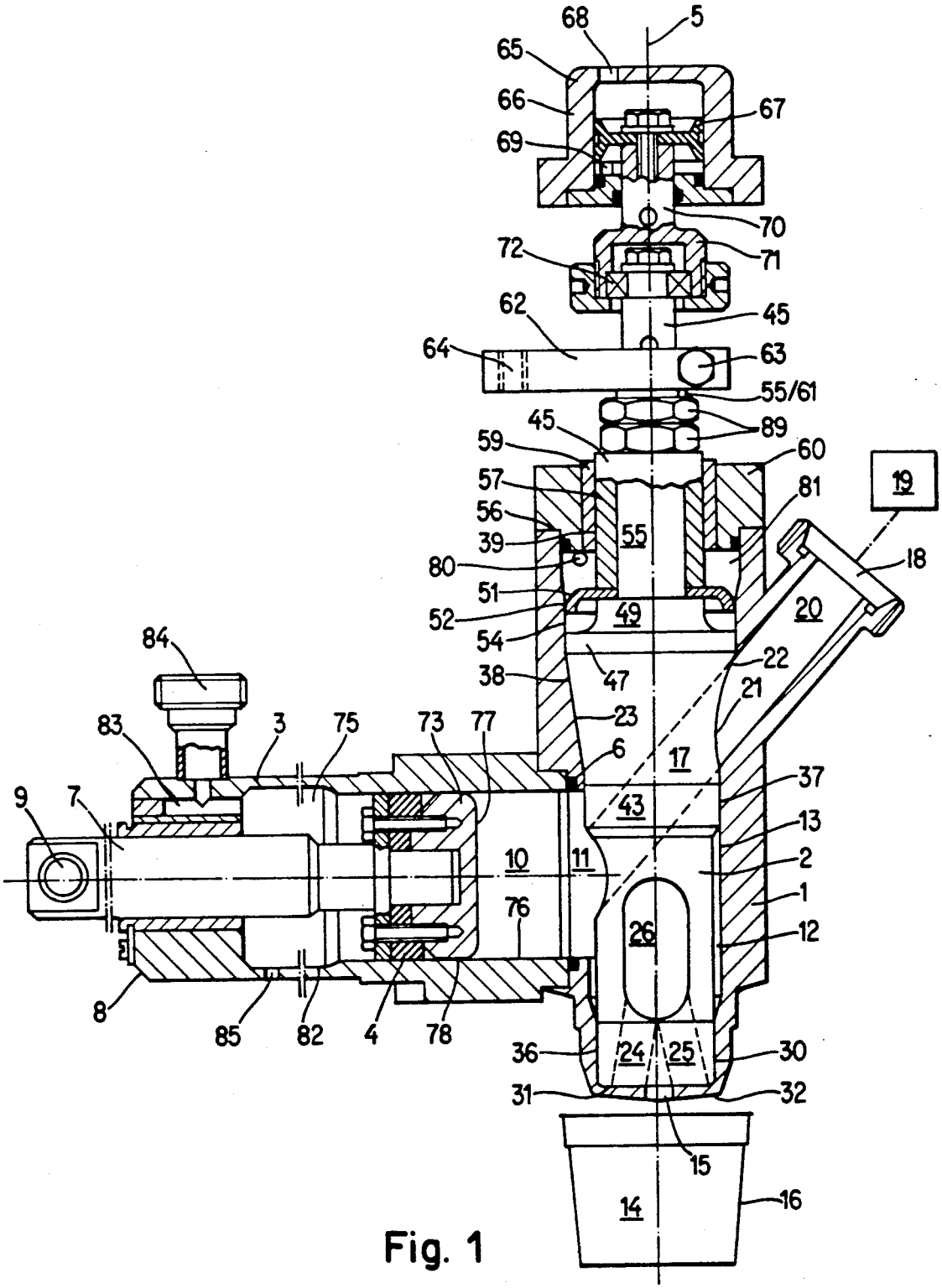
FIG. 1: a longitudinal sectional view of a filling valve with exposed admitting and closed dispensing opening.
Figure 2:
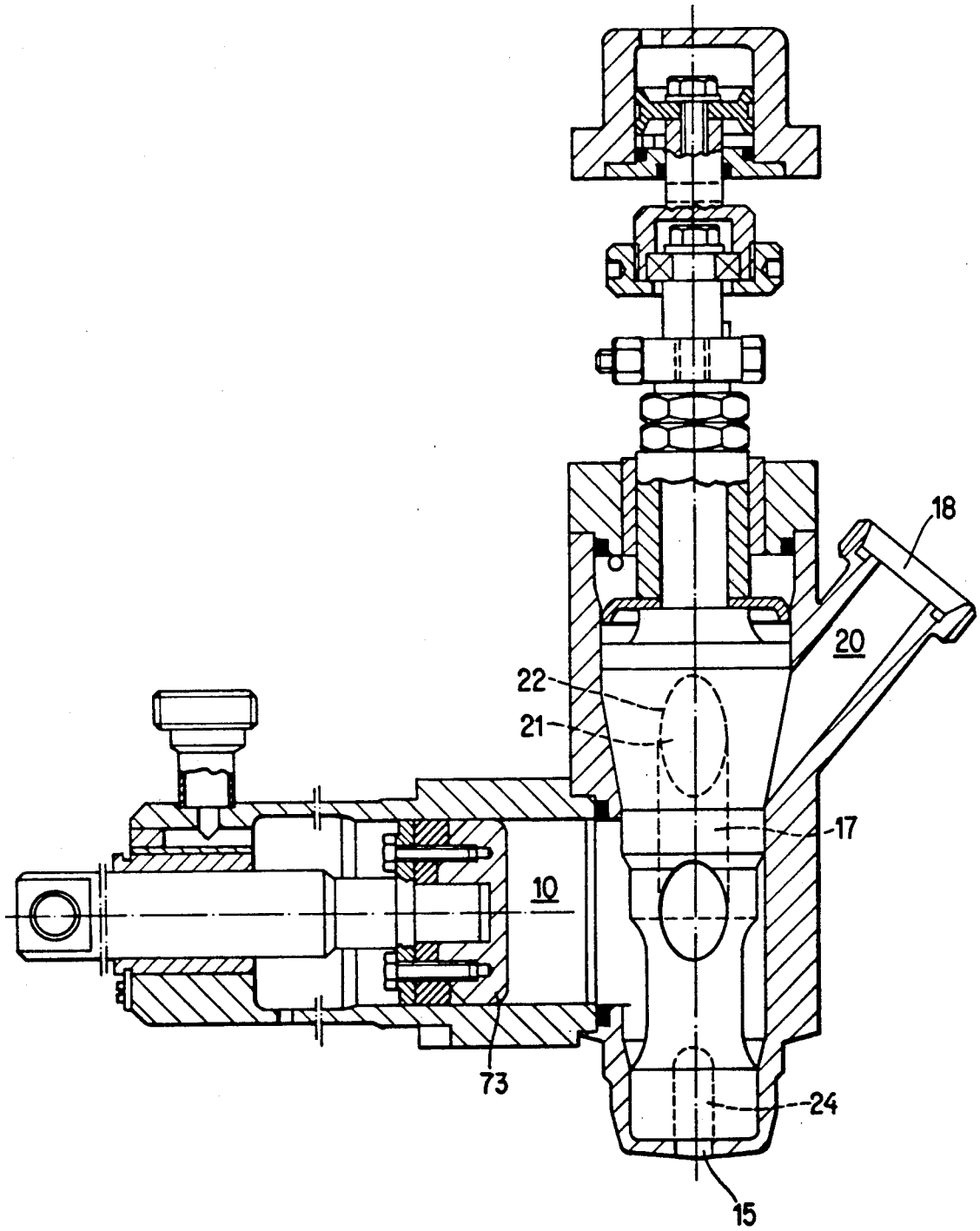
FIG. 2: a longitudinal sectional view of a filling valve with a closed admitting opening and exposed dispensing opening.

A filling valve consists essentially of a housing (1), a sealing piston (2), a metering cylinder (3) and a metering piston (4). The sealing piston (2) is rotatably mounted in the housing (1). The housing (1) and the sealing piston (2) have a common axis (5) about which the sealing piston (2) can be turned within the housing (1). This axis (5) extends substantially in a vertical direction. The metering cylinder (3) which extends substantially in a horizontal direction is disposed at right angles to this axis (5) and is connected in a liquid-tight manner by seals (6) with the housing (1).

The metering piston (4) is disposed in the interior of the metering cylinder (3) for reciprocatory movement in its longitudinal direction. A piston rod (7) of this metering piston extends from that end (8) of the metering cylinder (3) which is remote from the housing (1). At this end (8), the piston rod (7) is provided with a coupling element (9) by means of which the piston rod (7) can be coupled to a non-illustrated drive which is adapted to move the metering piston (4) in the longitudinal direction of the metering cylinder (3).

The metering cylinder (3) communicates with the housing (1) in the region of a metering chamber (10). This metering chamber (10) is provided primarily in the housing (1). In the region of the metering chamber (10) the sealing piston (2) has a cross section which is smaller than that in the internal space (11) which is provided in the housing (1). In this manner, there is formed in the internal space (11) between the sealing piston and an adjacent surface (13) an annular space (12) in which a mass (14) which is to be dispensed by the filling valve can gather prior to being introduced into a vessel (16) to be filled through dispensing openings (15). However it is also possible to form the filling valve without an annular space (12).

The metering chamber (10) communicates with an admitting channel (17) which extends through the sealing piston (2) at an angle to the axis (5) in a direction upwardly and away from the vessel (16). This admitting channel (16) communicates by way of a connector (18) with a magazine (19) in which the mass (14) to be dispensed is confined. The connector (18) extends through the housing (1) in which it forms an admitting opening (20). From this admitting opening (20) the admitting channel (17) extends to an inlet opening (21) and into the sealing piston (2). The inlet opening (21) is surrounded by an inlet sealing edge (22) which, during rotation of the sealing piston (2) about its axis, (5) is guided for movement close to an internal surface (23) of the housing (1) adjacent the inlet opening (21).

In addition, the annular space (12) communicates with two filling channels (24, 25) by way of an outlet (26). This outlet (26) constitutes a recess in the sealing piston (2) which, in the open position of the filling valve, faces toward the metering chamber (10) and communicates with the latter. The filling channels (24, 25) extend from the outlet 26 substantially in a vertical direction toward the dispensing openings (15) and register with the dispensing opening in the open position of the filling valve. The filling channels (24, 25) can be disposed at an angle to the axis (5) and can extend in a V-formation. Each of them communicates with the outlet (26) at an acute angle and their ends which are located opposite the outlet (26) extend in a direction toward the dispensing openings (15, 15*a*) which register therewith. The center points (27, 27*a*) of these dispensing openings (15, 15*a*) are located on a diametral line (28) which extends through the housing (1). The distance of the center points (27, 27*a*) from each other is selected in such a way that it corresponds to the length of a radius which determines a ring-shaped cross section (29) of the housing (1) at its lower end (30) which is adjacent the dispensing openings (15, 15*a*).

The lower end (30) of the housing is closed by a bottom (31) through which the two dispensing openings (15, 15*a*) extend. The internal surface (32) of this bottom (31) faces the internal space (11) and is provided with a high precision finish which eliminates all unevenesses. A surface (33) of the sealing piston (2) has a corresponding high precision finish and contacts the internal surface (32), the surface (33) being provided at the end of the sealing piston that is adjacent the lower end (30). The surface (33) is guided by the internal surface (32) when the sealing piston (2) carries out a rotary movement in the internal space (11) about its axis (5). During such rotary movements, the outlet openings (34, 34*a*) which communicate with the filling channels (24, 25) in the surface (33) are guided immediately above the dispensing openings. The outlet openings (34, 34*a*) are surrounded by a sealing edge (35).

This sealing edge (35) is so sharp that it is capable of shearing off a flow of mass (14) which extends through the dispensing opening (15) even when such mass contains relatively solid constituents.

The outlet openings (34, 34*a*) are disposed with reference to the dispensing openings (15) in such a way that the dispensing openings (15) discharge only a quantity of the mass (14) which is confined in the metering chamber (10). Therefore, care should be taken that, during the interval when the dispensing openings (15, 15*a*) are exposed, no mass (14) can be conveyed from the magazine (19) into the metering chamber (10). Thus, the admitting channel (17) must be sealed from the admitting opening (20) while the dispensing openings (15, 15*a*) are exposed. In order to ensure reliable operation of the filling valve, the dispensing openings (15, 15*a*) should be exposed longer than the duration of a connection between the admitting opening (20) and the admitting channel (17). In order to achieve such operation of the filling valve, the inlet opening (21) is located on a radius of the sealing piston (2) which is greater than that of the outlet openings (34, 34*a*) of the filling channels (24, 25). In this manner, the inlet opening (21) covers a greater distance than the outlet openings (34, 34*a*) while the sealing piston (2) turns through the same angle.

Furthermore, timely closing of the inlet opening (21) is also achieved in that this inlet opening (21) is limited to a substantially smaller circumferential angle of a conical sealing surface (44) of the sealing piston (2) than the outlet openings (34, 34*a*). Thus, the inlet opening (21) is limited to a circumferential extending angle the magnitude of which corresponds to two-thirds of the angle at the legs of which are disposed the outlet openings (34, 34*a*). In view of the fact that the diameter of the sealing piston in the region of the inlet opening (29) is substantially twice the diameter in the region of the outlet openings (34, 34*a*), one ensures that when the dispensing openings (15, 15*a*) are exposed, the admitting opening (20) is reliably sealed while the sealing piston (2) completes an angular movement through the same angle.

In addition, the outlet openings (34, 34a) are shifted relative to the dispensing openings (15) through an angle of the sealing piston (2) in excess of 90 degrees when the sealing piston (2) assumes a position in which the inlet opening (21) registers with the admitting opening (20).

The sealing piston (2) is reliably guided in friction bearings (36, 37, 39) in several portions of the housing (1). The friction bearing (36) is provided in a lower portion of the internal space (11) which is adjacent the dispensing openings (15, 15a). This lower part (40) has a cylindrical internal surface (41) which is contacted by an outer cylinder (42) provided on the sealing piston (2). In addition, the lower end surface (33) of the sealing piston (2) is guided in axial direction by the internal surface (32).

The friction bearing (37) is provided at the upper end of the metering chamber (10) remote from the friction bearing (36). This friction bearing (37) has a cylindrical sliding surface (43) which is mounted on a corresponding internal cylindrical surface provided in the housing (1). This internal cylindrical surface is formed by the surfaces surrounding the internal space (11). Due to its large-surface mounting in the friction bearings (36, 37) at both sides of the metering chamber (10), a migration of the sealing piston (2) in the course of the dispensing operations is impossible.

Furthermore, the sealing piston (2) is guided with a minimum of play along the sealing surface (44) at the upper side of the cylindrical sliding surface (43) which faces away from the metering chamber (10). This sealing surface (44) is provided on the sealing piston (2) and has a conical shape. In the region of this conical sealing surface (44), the sealing piston (2) has a cross section which continuously increases from the cylindrical sliding surface (43) in a direction toward its upper end (45) remote from the friction bearing (37).

This conical sealing surface (44) sealingly engages a correspondingly configurated conical internal surface (46). This conical internal surface is provided in the housing (1). The inlet opening (21) is provided in the region of the conical sealing surface (44) so that the inlet sealing edges (22) are defined by the conical sealing surface (44). The admitting channel (17) extends in the region of the conical sealing surface (44) at an angle through the sealing piston (2) and communicates with the metering chamber (10) beneath the cylindrical sealing surface (43) in the region of the surface (13).

In a direction toward the upper end (45), the conical sealing surface (44) is adjacent a cylindrical collar (47) which is mounted in a corresponding cylindrical internal surface (48) of the housing (1). Adjacent to this cylindrical collar (47) the diameter of the sealing piston (2) decreases in a direction toward its upper end (45) and forms an abutment (49). The upper end (50) of this abutment (49) faces away from the cylindrical collar (47) and has an abutment surface which contacts a sealing sleeve (51). This sealing sleeve (51) constitutes a cupped sleeve and its marginal portion (52) is bent in a direction toward the cylindrical collar (47). The marginal portion (52) has an outer side (53) which faces the housing (1) and constitutes a seal by means of which the sealing sleeve (51) engages an adjacent internal surface (54) in the internal space (11). In this manner, the outer side (53) constitutes a seal which is pressed against the internal surface (54) and sealingly engages the latter in a reliable manner in a response to development of pressure beneath the sealing sleeve (51).

The central opening of the sealing sleeve (51) is guided by a cylindrical portion (55) which is adjacent the abutment (49) in a direction toward the upper end (55). The cylindrical portion (55) of the sealing piston (2) extends beyond the upper end (56) of the housing (1) which is remote from the bottom (31).

The cylindrical portion (55) guides a sleeve (57) which can be made, for example, of a bearing metal. This sleeve (57) is pressed in a direction toward the upper end (50) of the abutment (49) by a lock nut (89) so that the sealing sleeve (51) is clamped between the abutment and the sleeve (57). In addition, the external surface (58) of the sleeve (57) which faces away from the cylindrical portion (55) constitutes the friction bearing (38). The latter is formed by the external surface (58) on the one hand and an internal shell (59) on the other hand which is recessed into a cover (60) which is adjacent the upper end (56) of the housing (1).

The lock nut (89) is threaded onto a thread (61) which is adjacent the cylindrical portion (55) as seen in the direction toward the upper end (45). Adjacent the thread (61), as seen in a direction toward the upper end (45), the sealing piston (2) is fixedly clamped to a lever (62) by way of a clamping screw (63). The lever (62) extends from the sealing piston (2) radially outwardly and serves as a means for connecting, by way of a bore (64) to a non-illustrated drive by means of which the sealing piston (2) should perform angular movements in the housing (1). At its upper end (45), the sealing piston (2) is provided with an adjusting drive (65) by means of which it can perform movements in the longitudinal direction of the axis (5). This adjusting drive (65) consists essentially of a piston (67) which is reciprocably mounted in a cylinder (66). Both sides of this piston (67) can be acted upon by a pressurized medium which flows in or out through an upper port (68) or a lower port (69). The two ports (68, 69) communicate with the interior of the cylinder (66). The upper port (68) communicates with an upper chamber of the cylinder (66) as seen in the direction of movement of the piston (67) which is located above the piston (67) whereas the lower port (69) communicates with a chamber beneath the piston (67).

The piston (67) is secured to a piston rod (70) which sealingly extends from the cylinder (66) in a direction toward the upper end (45) of the sealing piston (3).

The lower end of the piston rod (70) which is remote from the piston (67) is provided with a bearing (71) in which the sealing piston (2) is mounted in a roller bearing (72) for rotation about its axis (5). The roller bearing (72) is capable of transmitting to the sealing piston (2) forces which are applied by the piston (67) to the piston rod (70) so that the sealing piston can perform rotary movement as well as transversal movement in the direction of its longitudinal axis (5).

The front end of the metering piston (4) which is adjacent the metering chamber (10) is provided with a guide piston (73) the edges (74) of which contact the internal surfaces (76) of an internal space (75) extending through the metering cylinder (3). This guide piston (73) has a pressure applying surface (77) which faces the metering chamber (10) and acts upon the mass (14) in the metering chamber (10). The guide piston (73) is adjacent a sealing surface (78) as seen in the direction toward the coupling element (9). The sealing surface (78) sealingly guides the metering piston (4) along the internal surface (76). As a result of movements of the metering piston (4), the mass (14) is metered during flow into the metering chamber (10) or outflow into the vessel (16).

Figure 3:
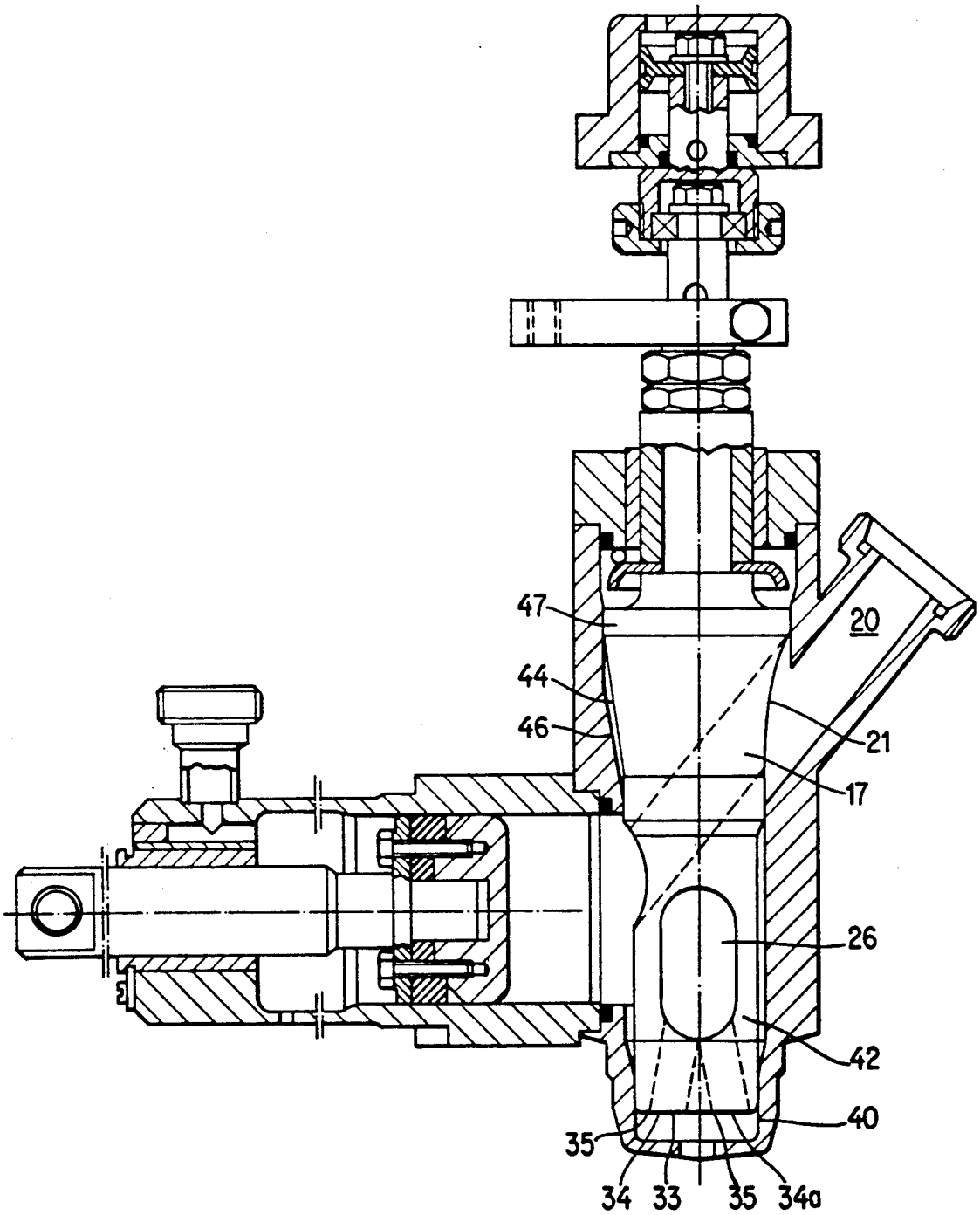
FIG. 3: a longitudinal sectional view of a filling valve the sealing piston of which is located in a position for cleaning.
Figure 4:
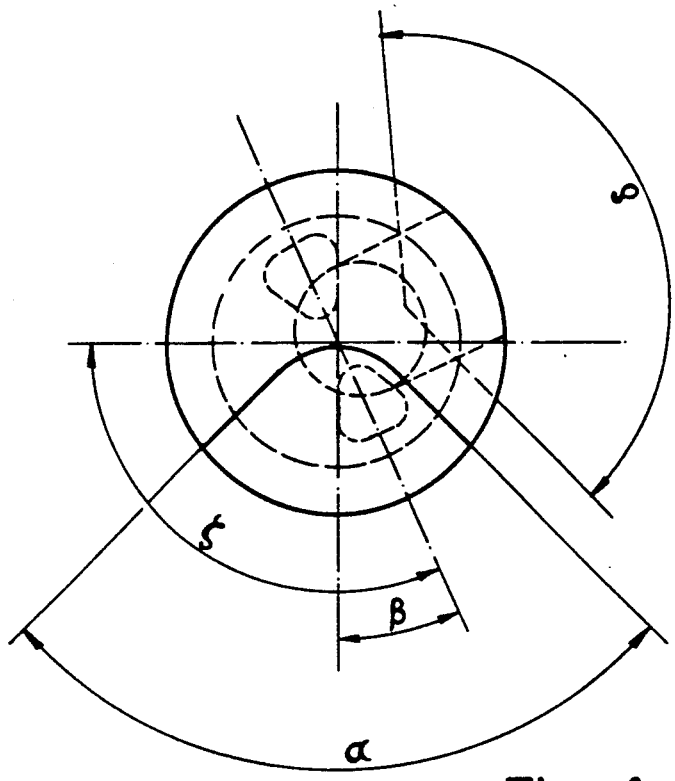
FIG. 4: a schematic representation of dispensing opening for explanation of the closing angles.
Figure 5:
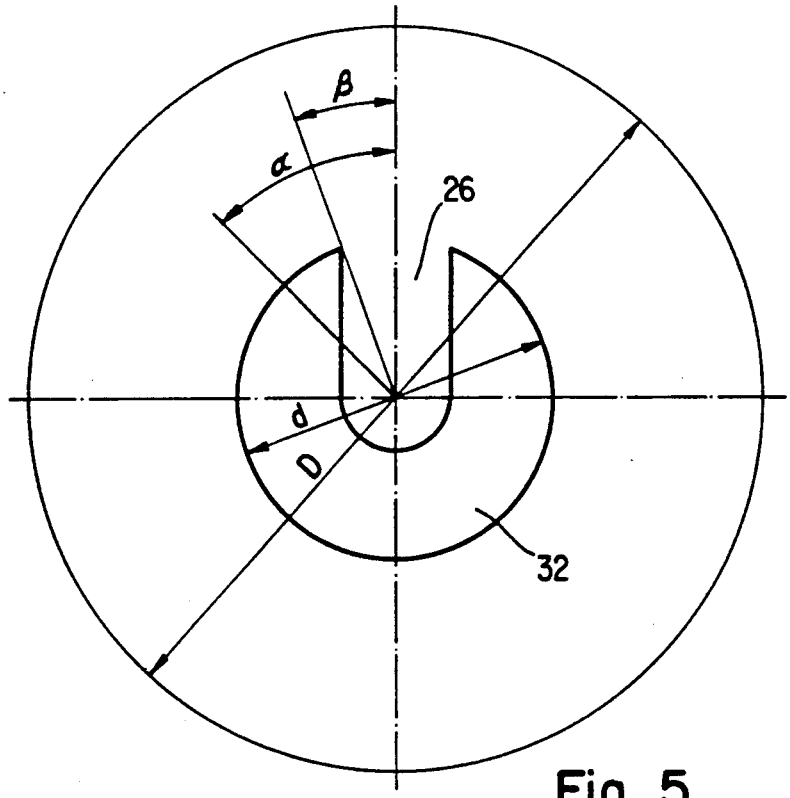
FIG. 5: an overview sketch for illustration of several functional sections.
Figure 7:
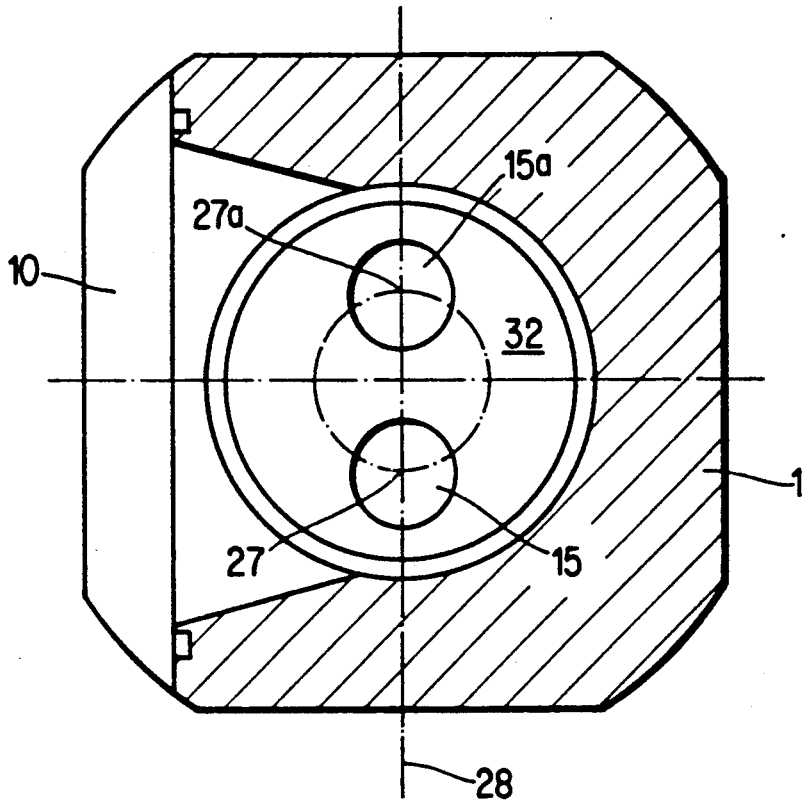
FIG. 7: an enlarged horizontal section through the housing.

Not only the sealing piston (2) but also the metering piston (4) can be subjected to cleaning without it being necessary to remove them from the housing (1) or the metering cylinder (3). To this end, the adjusting drive (65) moves the sealing piston (2) to a position (79) for cleaning (compare FIG. 3). In such cleaning position (79), the cooperating surfaces of the friction bearings (36, 37, 38) are spaced apart from each other to such an extent that they can be rinsed by a cleaning liquid.

Such cleaning liquid is admitted into the internal space (11) not only through the connector (18) but also through an inlet (80) for cleaning medium. This inlet (80) for cleaning medium discharges into the internal space (11) beneath the cover (60) in the region of an enlargement (81) which is provided in the upper end (56) of the housing (1). Since the conical sliding surface (44) is also lifted off the conical internal surface (46) in the cleaning position (79), these surfaces can be rinsed from all sides by the cleaning liquid. Such cleaning liquid flows around the sealing sleeve (51) which is not in contact with the wall surrounding the internal space (11) in the region of the enlargement (81) in the cleaning position (70).

In a similar manner, the metering piston (4) can also be pulled into an enlarged space (82) which is provided in a rear part of the metering cylinder (3) remote from the metering chamber (10). This enlarged space (82) is in communication with an inlet (84) for cleaning medium by way of a cleaning channel (83) by means of which the cleaning medium can be admitted into the the metering cylinder (4). Such cleaning medium flows around the metering piston (4) in the interior of the enlarged space (82) and enters the metering chamber (10) through the metering cylinder (3) so that the sealing piston (2), which is located in the cleaning position (79) can be rinsed and the cleaning liquid issues from the dispensing openings (15, 15*a*) after having flown through the filling channels (24, 25). Another part of the cleaning liquid which is contained in the metering cylinder (3) leaves the metering cylinder (3) by way of a discharge opening (85) which is provided in the metering cylinder (3).

When a communication is established between the connector (18) and the magazine (19), the sealing piston (2) is turned by the lever (62) to a filling position in which the mass (14) can enter the admitting channel (17) through the admitting opening (20) and can flow from the channel into the metering chamber (10).

The inflow of the mass (14) can be promoted in that the metering piston (4) is pulled in a direction toward the enlarged space (82) so that a subatmospheric pressure develops in the metering chamber (10) to suck the mass (14) into the metering chamber (10). After the metering chamber (10) has been filled with a desired quantity of the mass (14), the sealing piston (2) is rotated about its axis (5) with assistance from the force which is applied to the lever (62). In this manner, the inlet sealing edges (22) seal the admitting opening (20) so that no additional mass (14) can enter the admitting channel (17). Immediately after the inlet opening (21) is sealed, the filling channels (24, 25) have been rotated to a position in which they register with the dispensing openings (15, 15*a*). At such time, the mass (14) can flow into and can fill the vessel (16) by issuing from the dispensing openings (15, 15*a*). The rate of outflow of the mass (14) from the metering chamber (10) is metered in that the metering piston (4) is moved in a direction toward the metering chamber (10). At such time, the mass (14) enters the filling channels (24, 25) by way of the outlet (26). Since the cross sections of the outlet openings (34, 34*a*) are smaller than those of the dispensing openings (15, 15*a*), one ensures that the mass (14) does not wet the outlet openings (34, 34*a*) while leaving the filling channels (24, 25).

When the vessel (16) is filled, the sealing piston (3) is again rotated about its axis (5) so that the sealing edges (35) then shear off the stream of the mass (14) which flows through the outlet openings (34, 34*a*). Immediately after the filling channels (24, 25) are sealed, the inlet sealing edge (22) again establishes a connection between the admitting opening (20) and the admitting channel (17). At the same time, the direction of movement of the metering piston (4) is reversed so that it again moves in a direction toward the enlarged space (82) to thereby suck the mass (14) into the metering chamber (10).

For the purpose of cleaning, a pressurized medium is admitted through the lower port (69) into the lower part of the cylinder (66) so that the piston (87) is pushed in the cylinder (66) in a direction toward the upper port (68) to thereby expel pressurized medium which may be contained in the upper part of the cylinder (66) by way of the upper port (68). Such movement of the piston (67) is transmitted to the sealing piston (2) by way of the bearing (71) and the roller bearing (72) so that the sealing piston moves in the direction of its axis (5) and is pulled out of the housing (1). In this manner, the mutually engaging sliding surfaces of the friction bearings (36, 37, 38) are disengaged from each other so that they can be rinsed by a cleaning liquid from all sides. In a corresponding manner, the metering piston (4) is pulled into the enlarged space (82) and cleaning liquid is admitted into the metering cylinder (3) by way of the inlet (84) for cleaning medium. The streams of the medium to be metered which are rinsed into the housing (1) by way of the connector (18) and the inlet (80) for cleaning medium merge into the stream of cleaning medium which cleans the metering cylinder (3) in the region of the metering chamber (10). The cleaning medium is thereupon evacuated by way of the outlet (26), through the filling channels (24, 25) and the dispensing openings (15, 15*a*).

After the cleaning medium has been evacuated from the housing (1) as well as from the metering cylinder (3), a pressure medium is admitted through the upper port (68) of the cylinder (66) to act upon the piston (67) so that the latter slides back to its operative position in the direction of its longitudinal axis (5). At such time, the pressure medium which is confined beneath the piston (67) is expelled by way of the lower port (69). The forces which act upon the sealing piston (2) are transmitted to the sealing piston (2) by way of the bearing (71). At the same time, the metering piston (4) is pushed to its operative position in a direction toward the metering chamber (10) so that the filling of vessels (16) can be resumed.

The pressure medium which acts upon the piston (67) causes the surface (33) of the sealing piston (2) to bear against the internal surface (32) of the housing (1) and the sealing piston is thus held in its operative position. In such operative position, one can expect that the outflow of the mass (14) from the dispensing openings (15, 15*a*) is quieted down since the mass (14) flows toward the dispensing openings (15, 15*a*) in the form of a laminar stream in view of the considerable length of the filling channels (24, 25).

We claim:

1. Filling valve for dispensing flowable materials, comprising a housing having a bottom wall with at least one material dispensing opening, said housing further having a material admitting inlet opening above said at least one dispensing opening and a metering chamber communicating with said inlet opening; a piston mounted in said housing for angular movement about a substantially vertical axis and having a bottom surface adjacent said bottom wall, said piston further having at least one filling channel with an inlet and with an outlet, said outlet being provided in said bottom surface; means for turning said piston between at least one first position in which said inlet communicates with said chamber and said outlet communicates with said at least one dispensing opening and at least one second position in which said outlet is sealed from said dispensing opening, said bottom surface having a sealing edge at least partially surrounding said outlet and arranged to shear off the flow of material from said channel into said at least one dispensing opening in response to turning of the piston from said first to said second position; and an adjusting drive coupled to said piston for moving said piston in said housing in the longitudinal direction of said piston toward and away from said bottom wall.

2. Filling valve for dispensing flowable materials, comprising a housing having a bottom wall with two material dispensing openings, said housing further having a material admitting opening above said dispensing openings and a metering chamber communicating with said inlet opening; a piston mounted in said housing for angular movement about a substantially vertical axis and having a bottom surface adjacent said bottom wall, said piston further having two filling channels each including an inlet and an outlet, said outlets being provided in said bottom surface; means for turning said piston between at least one first position in which said inlets communicate with said chamber and said outlets communicate with said dispensing openings and at least one second position in which said outlets are sealed from said dispensing openings, said bottom surface having a sealing edge at least partially surrounding said outlets and arranged to shear off the flow of material from said channels into said dispensing openings in response to turning of the piston from said first to said second position; a metering piston provided in said housing adjacent said metering chamber; and means for moving said metering piston towards and away from said vertical axis to expel material from said metering chamber into said channels, said two filling channels extending through said piston in a V-shaped configuration and communicating with a further outlet which is provided in the piston and is connected with the metering chamber of the housing by way of a metering opening.

3. Filling valve for dispensing flowable materials, comprising a housing having a bottom wall with at least one material dispensing opening, said housing further having a material admitting inlet opening above said at least one dispensing opening and a metering chamber communicating with said inlet opening; a piston mounted in said housing for angular movement about a substantially vertical axis and for reciprocatory movement in the direction of said axis and having a bottom surface adjacent said bottom wall, said piston further having at least one filling channel with an inlet and with an outlet, said outlet being provided in said bottom surface; and means for turning said piston between at least one first position in which said inlet communicates with said chamber and said outlet communicates with said at least one dispensing opening and at least one second position in which said outlet is sealed from said dispensing opening, said bottom surface having a sealing edge at least partially surrounding said outlet and arranged to shear off the flow of material from said channel into said at least one dispensing opening in response to turning of the piston from said first to said second position.

4. Filling valve according to claim 3, wherein in its upper position the piston assumes a position for cleaning in which it is surrounded by a flowing cleaning liquid.

5. Filling valve according to claim 4, wherein the cleaning liquid is admitted into said housing by way of inlets for said cleaning liquid.

6. Filling valve according to claim 5, wherein the inlets for cleaning medium are provided in the regions of annular spaces which are provided in said housing and surround the piston in its upper position.

7. Filling valve for dispensing flowable materials, comprising a housing having a bottom wall with at least one material dispensing opening, said housing further having a material admitting inlet opening above said at least one dispensing opening and a metering chamber communicating with said inlet opening; a piston mounted in said housing for angular movement about a substantially vertical axis and having a bottom surface adjacent said bottom wall, said piston further having at least one filling channel with an inlet and with an outlet, said outlet being provided in said bottom surface and said piston further having an upper end which projects from the housing; means for turning said piston between at least one first position in which said inlet communicates with said chamber and said outlet communicates with said at least one dispensing opening and at least one second position in which said outlet is sealed from said dispensing opening, said bottom surface having a sealing edge at least partially surrounding said outlet and arranged to shear off the flow of material from said channel into said at least one dispensing opening in response to turning of the piston from said first to said second position, said turning means comprising a lever which is connected with said upper end and a drive for said lever; an adjusting drive coupled to the upper end of said piston to move the piston in its longitudinal direction; a metering piston provided in said housing adjacent said metering chamber; and means for moving said metering piston towards and away from said vertical axis to expel material from said metering chamber into said at least one channel.

8. Filling valve according to claim 7, wherein the adjusting drive comprises a third piston and a cylinder, said third piston being movably guided in the cylinder in the longitudinal direction of the first named piston.

9. Filling valve according to claim 8, wherein the third piston has a piston rod which extends from the cylinder and is provided with a bearing in which the first named piston is rotatably mounted.

10. Filling valve according to claim 9, wherein the bearing for the first named piston constitutes a roller thrust bearing.

* * * * *

UNITED STATES PATENT AND TRADEMARK OFFICE

CERTIFICATE OF CORRECTION

PATENT NO. : 5,108,014

DATED : April 28, 1992

INVENTOR(S) : Manfred NORDMEYER et al.

It is certified that error appears in the above-identified patent and that said Letters Patent is hereby corrected as shown below:

Title page, item

[73] Assignee: "Leider" should read --Lieder--.

Col. 1, line 40, "wedge" should read --wedged--.

Signed and Sealed this

Twenty-eighth Day of September, 1993

Bruce Lehman

*Attest:*

BRUCE LEHMAN

*Attesting Officer*

*Commissioner of Patents and Trademarks*